US005788122A

United States Patent [19]

Keller

[11] Patent Number: 5,788,122

[45] Date of Patent: Aug. 4, 1998

[54] MIXING DEVICE WITH ATTACHMENT

[76] Inventor: Wilhelm A. Keller, Obstgartenweg 9, CH-6402 Merlischachen, Switzerland

[21] Appl. No.: 91,294

[22] Filed: Jul. 15, 1993

[30] Foreign Application Priority Data

Jul. 22, 1992 [EP] European Pat. Off. ..... 92810561

[51] Int. Cl.[6] ..... B67D 3/00

[52] U.S. Cl. ..... 222/137; 222/145.6; 222/526; 222/567; 222/570

[58] Field of Search ..... 222/137, 145, 222/567, 568, 570, 575, 526, 145.5, 145.6

[56] References Cited

U.S. PATENT DOCUMENTS

| | | | |
|---|---|---|---|
| 803,113 | 10/1905 | Klusmire | 222/526 |
| 2,040,545 | 5/1936 | Byers . | |
| 2,715,480 | 8/1955 | Livingstone | 222/568 X |
| 2,815,895 | 12/1957 | Reed | 222/568 |
| 3,534,891 | 10/1970 | Bozich | 222/526 X |
| 3,592,349 | 7/1971 | Baugh . | |
| 4,241,855 | 12/1980 | Yoshioka . | |
| 4,258,884 | 3/1981 | Rogers | 222/570 X |
| 4,957,225 | 9/1990 | Childers | 222/568 |
| 4,981,241 | 1/1991 | Keller | 222/137 |
| 4,995,540 | 2/1991 | Colin et al. | 222/137 X |
| 5,033,650 | 7/1991 | Colin et al. | 222/567 X |
| 5,271,538 | 12/1993 | Lipker | 222/526 X |
| 5,297,697 | 3/1994 | Boring | 222/568 X |

FOREIGN PATENT DOCUMENTS

| | | | |
|---|---|---|---|
| 1238023 | 6/1988 | Canada | 222/570 |
| 0179738 | 4/1986 | European Pat. Off. . | |
| 0182217 | 5/1986 | European Pat. Off. . | |
| 0351358 | 1/1990 | European Pat. Off. . | |
| 226561 | 9/1989 | Japan | 222/526 |

*Primary Examiner*—Kevin P. Shaver
*Attorney, Agent, or Firm*—Foley & Lardner

[57] ABSTRACT

The mixer for a dispensing appliance having a double cartridge is provided at its dispensing end with an attachment which is rotatably mounted thereon by snap-in coupling parts. Moreover, the mixer is provided at its dispensing end with a circular bead and the attachment is provided with a corresponding groove. The bead and the external diameter of the dispensing end of the mixer, on one hand, and the groove and the internal diameter of the attachment, on the other hand, having such dimensions that the attachment is rotatably maintained on said mixer. The design of the snap-in coupling parts allows the use of the same mixer for all kinds of attachments, whereby a rational manufacture becomes possible. Moreover, the rotatable coupling of the attachment allows a fine adjustment of the dispensing end of the attachment with respect to the application surface.

13 Claims, 1 Drawing Sheet

MIXING DEVICE WITH ATTACHMENT

BACKGROUND OF THE INVENTION

The present invention refers to a mixing device for a dispensing appliance having a double cartridge, comprising a removably mounted attachment.

Mixing devices or mixing tubes for dispensing appliances having double cartridges are secured to the dispensing appliance and serve the purpose of mixing the materials coming from the storage cylinders in order to allow their dispensing at the working site. In order to give the dispensed substance a certain shape, it is known either to shape the dispensing end of the mixer, e.g. with a triangular or rectangular outlet opening, or to provide the end with an oval or any other shape, or to mount an attachment thereto.

If a mixing tube having a shaped dispensing end is used, a particular mixing tube must be manufactured for each type of application, which makes the manufacture significantly more expensive. The manufacture of attachments having a thread in view of mounting them on a corresponding threaded portion of the mixing tube is previously known. Since in many applications the dispensing end must have a determined orientation with respect to the application surface, said attachments must either be screwed onto the mixer tube in a determined position, or further complicated measures would have to be taken in order to align said attachment to the application surface.

SUMMARY OF THE INVENTION

On this background, it is the object of the present invention to provide a mixing tube with attachment which allows the use of any desired attachment and a simplified series production. This object is attained by a mixer for a dispensing appliance having a double cartridge wherein means for a sealing, rotatable snap-in mount of an attachment are provided at the dispensing end of said mixer.

BRIEF DESCRIPTION OF THE DRAWINGS

The invention is explained in more detail hereinafter with reference to a drawing of embodiments.

DETAILED DESCRIPTION OF THE INVENTION

Figure 1:
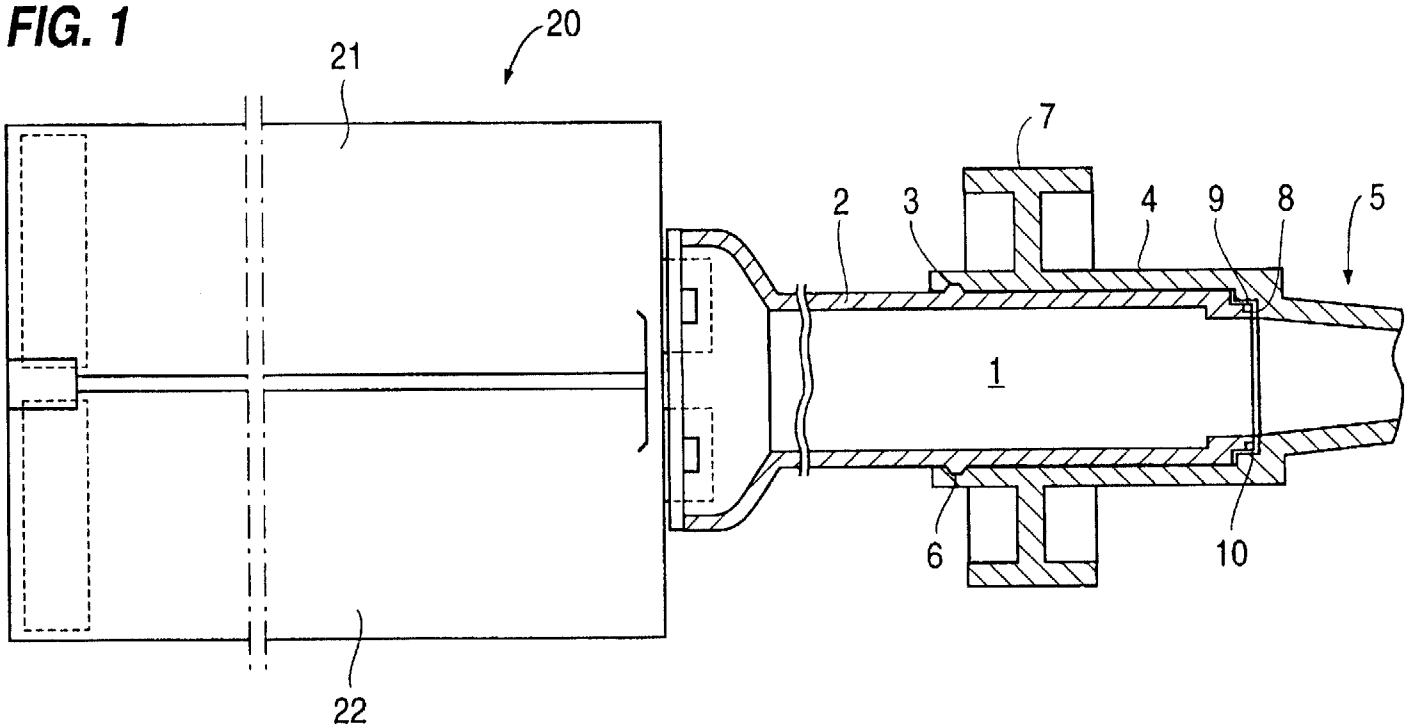
FIG. 1 shows a cross-section of the dispensing end of a mixer and a portion of the attachment of the invention.
Figure 2:
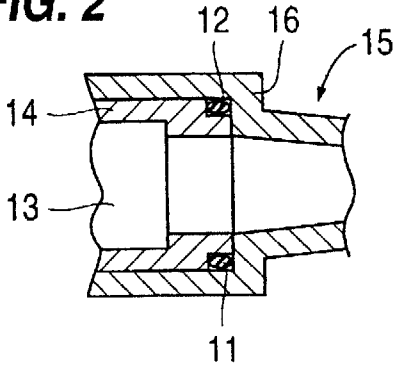
FIG. 2 shows an alternative embodiment of the invention.

In FIG. 1, the dispensing end 2 of a mixer 1, which is represented without the mixing helix, is shown. The mixer serves to mix first and second substances ejected from first and second cartridges 21, 22 of a double cartridge dispensing appliance 20. At a certain distance from the end edge of the mixer, a snap bead 3 is provided. To the dispensing end of the mixer, the rear end 4 of an attachment 5 is attached which is provided near its end with a groove 6 corresponding to bead 3. The two parts, i.e. the external diameter of the mixer and of said bead, on one hand, and the internal diameter of the attachment and of said groove, on the other hand, are dimensioned in such a manner that said attachment is allowed to easily rotate around the mixer axis. For a better handling, i.e. for an easy alignment of the dispensing end with respect to the application surface, a hand-wheel 7 or the like is arranged on the attachment.

Between attachment 5 and the mixer, a sealing means must be present in order to prevent the dispensed substance from flowing out. One solution according to FIG. 1 consists in a shoulder 8 which is provided at the end of the mixer and a corresponding shoulder 9 at the attachment which fits together with shoulder 8 in a sealing manner. Moreover, one of the two parts may be provided with a sealing lip. A sealing lip 10 is preferably provided on shoulder 9 of the attachment, see FIG. 1.

In cases where a high counterpressure acts upon the end 16 of the attachment, it is useful to provide a recess at shoulder 11 between dispensing end 14 of mixer 13 and end 16 of attachment 15, with a sealing device, e.g. an O-ring 12, being inserted therein.

Attachment 5 or 15 need not necessarily be the end piece for dispensing. The attachment may also serve as a coupling link to which other components can be coupled.

The use of an attachment or a coupling link with a snap-in mechanism simplifies the manufacture of mixers, a single type of mixer being provided to which different attachments are easily mountable.

I claim:

1. A mixer for a dispensing appliance having a double cartridge, comprising means for sealing and for rotatably snap-in mounting an attachment at a dispensing end of said mixer, said mounting and sealing means comprising a circular bead provided at a dispensing end of said mixer and a corresponding groove provided in a mounting end of said attachment, said bead and the external diameter of the dispensing end of said mixer, on one hand, and said groove and the internal diameter of said attachment, on the other hand, having such dimensions that said attachment is rotatably and sealingly maintained on said mixer, wherein the dispensing end of said mixer and the mounting end of said attachment each have a respective, sealingly engaging shoulder.

2. The mixer of claim 1, wherein one of said two shoulders is provided with a sealing lip.

3. The mixer of claim 1, wherein a sealing means is arranged in said shoulder of said dispensing end of said mixer.

4. An attachment for a mixer for a dispensing appliance having a double cartridge, comprising means for sealing and for rotatably snap-in mounting an attachment at a dispensing end of said mixer, said mounting and sealing means comprising a circular bead provided at a dispensing end of said mixer and a corresponding groove provided in a mounting end of said attachment, said bead and the external diameter of the dispensing end of said mixer, on one hand, and said groove and the internal diameter of said attachment, on the other hand, having such dimensions that said attachment is rotatably and sealingly maintained on said mixer, wherein the dispensing end of said mixer and one end of said attachment each have a respective, sealingly engaging shoulder.

5. The attachment of claim 4, wherein said attachment is provided with a handling means.

6. The attachment of claim 4, wherein one of said two shoulders is provided with a sealing lip.

7. A mixing apparatus, comprising:

means for dispensing a substance from said mixing apparatus, said dispensing means having a dispensing end from which said substance is dispensed;

a snap bead located on said dispensing means a predetermined distance from said dispensing end, said snap bead providing means for engaging a groove formed in an attachment;

a shoulder formed on said dispensing end providing means for engaging a shoulder formed on said attachment;

wherein an external dimension of said dispensing means, said snap bead, an internal dimension of said attachment, and said groove are sized to allow said attachment to rotate while attached to said mixer.

8. The mixing apparatus as set forth in claim 7, wherein said external dimension of said dispensing means is an external diameter and said internal dimension of said attachment is an internal diameter.

9. The mixing apparatus as set forth in claim 7, further comprising a sealing member disposed between said shoulder formed on said dispensing end and said shoulder formed on said attachment.

10. The mixing apparatus as set forth in claim 9, wherein said sealing member comprises an O-ring.

11. An attachment for placement over a dispensing means of a mixing apparatus, comprising:

a groove formed on an inside surface of said attachment, said groove providing means for engaging a snap bead located a predetermined distance from a dispensing end of said dispensing means;

a shoulder formed on said inside surface of said attachment providing means for engaging a shoulder formed on said dispensing end of said dispensing means; and a hand wheel formed on an outside surface of said attachment;

wherein said attachment being sealingly engaged with said apparatus and rotatable with respect to said mixing apparatus.

12. The attachment as set forth in claim 11, further comprising a sealing member disposed between said shoulder formed on said attachment and said shoulder formed on said dispensing end.

13. The attachment as set forth in claim 12, wherein said sealing member comprises an O-ring.

* * * * *